United States Patent [19]

Masucci et al.

[11] 4,273,948

[45] Jun. 16, 1981

[54] ELECTRODE HEIGHT CONTROL IN ELECTRO-SLAG REMELTING PROCESSES

[75] Inventors: Pasquale Masucci, Rome; Paolo Sommovigo, Pomezia, both of Italy

[73] Assignee: Centro Sperimentale Metallurgico S.p.A., Rome, Italy

[21] Appl. No.: 87,868

[22] Filed: Oct. 24, 1979

[30] Foreign Application Priority Data

Oct. 31, 1978 [IT] Italy ..... 51713 A/78

[51] Int. Cl.[3] ..... H05B 3/60

[52] U.S. Cl. ..... 13/9 ES

[58] Field of Search ..... 13/13, 9 ES, 9

[56] References Cited

U.S. PATENT DOCUMENTS 3,520,978 7/1970 Svendsen ..... 13/13

*Primary Examiner*—Roy N. Envall, Jr.

*Attorney, Agent, or Firm*—Young & Thompson

[57] ABSTRACT

Electrode immersion depth is controlled in an ESR process, in which two electrodes are connected in series to a power source and each of the electrodes has an independent feed mechanism. The assumption is made that the slag used in the ESR process has a composition which does not vary during the process, thus leading to the further assumption that two equal lengths of slag have equal electrical resistance. Hence the slag comprised between the electrode tips and the molten metal bath can be considered as two variable resistances which are equal only when the electrode tips are both at the same distance from the molten metal bath. These two variable resistances are used in an electrical bridge, which can be suitably balanced. Should one electrode be consumed more rapidly than the other, the thickness of the slag, as well as its electrical resistance, between the electrode tip and the molten metal will increase, thus unbalancing the bridge. The amplitude and direction of this unbalance will tell both which electrode is consumed more rapidly and at what rate, thus enabling the operator, or an automatic device, to correct the feed rate of the electrode.

2 Claims, 1 Drawing Figure

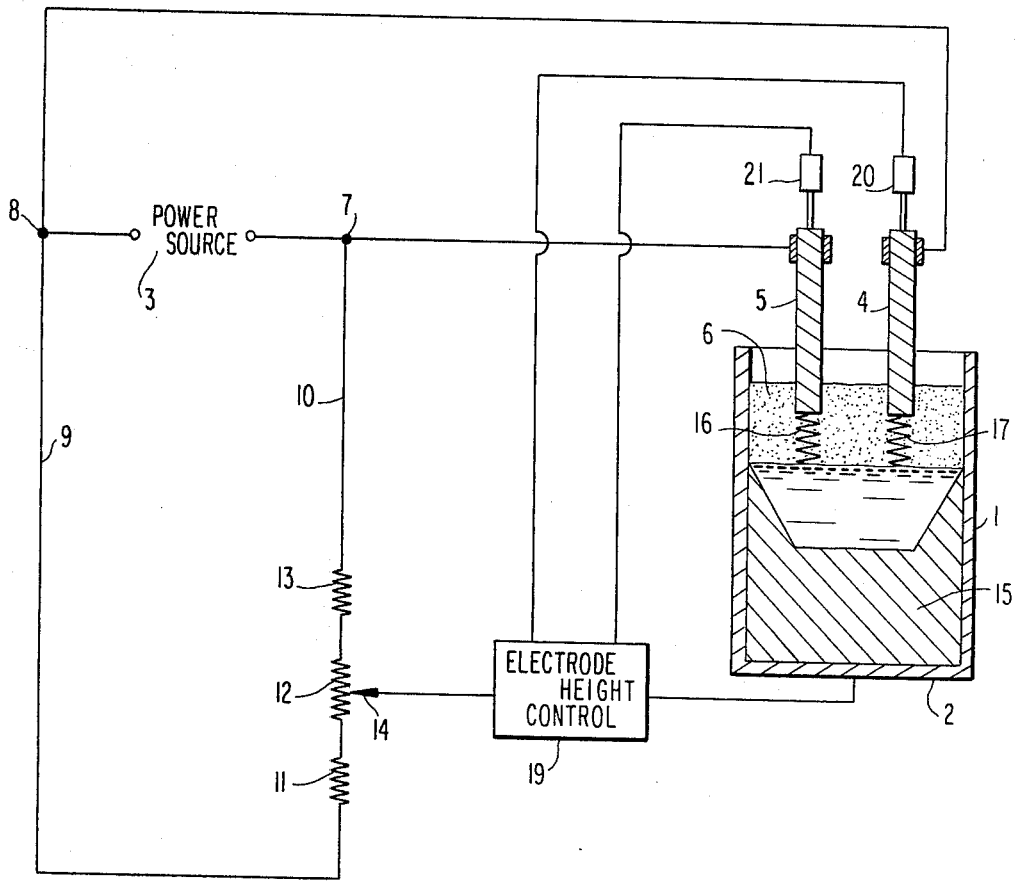
POWER SOURCE
ELECTRODE HEIGHT CONTROL
1
2
3
4
5
6
7
8
9
10
11
12
13
14
15
16
17
19
20
21

ELECTRODE HEIGHT CONTROL IN ELECTRO-SLAG REMELTING PROCESSES

The present invention relates to controlling the position of the electrodes in an electro-slag remelting (ESR) process. More precisely, the invention solves the problem of controlling and regulating the depth of immersion of the electrodes in the slag.

Direct current and alternating current ESR plants using the two-wire system are here involved, in which the electric circuit is closed between two electrodes, or electrode complexes, each connected to one terminal of the power supply circuit.

For a number of reasons well known to experts in the field, it usually happens that the two electrodes are not consumed at the same rate. This results in a number of difficulties which may even bring the ESR process to a halt.

Many devices have been proposed and built for regulating the rate of descent of the electrodes to match this to the rate at which they are consumed. However, as far as we are aware, these devices all operate on voltages comparable with the working voltage, to measure variations several orders of magnitude less. In typical cases variations amounting to only a few dozen millivolts on values of several dozen volts have to be measured. As will be appreciated, this involves the use of very costly, complex equipment in order to be able to detect variations of less than 0.5% in the working values, in a reliable, reproducible manner.

This is a particularly serious problem when it is considered that the operating environment is a steel mill where conditions are complicated and difficult and where interference and disturbances are almost certain to occur.

Thus, for instance, British Pat. No. 1,416,251 published on Dec. 3, 1975 discloses a system which involves the use of a voltmeter to measure the potential difference existing between each electrode and a conductor in electrical contact with the slag bath. This conductor is generally the bottom of the mold. When conditions are ideal the potential difference measured between an electrode and the bottom of the mold is equal to half the potential difference between the electrodes, but in practice this rarely occurs and in any case the measurements involved are always of the order of at least several dozen volts. Since the electrodes dip only a few centimeters into the slag, it is obvious that variations of electrode immersion amounting to but a few millimeters are important.

According to this British patent, if one electrode is consumed more rapidly than another, the thickness of the slag between the tip of the electrode and the bottom of the mold increases and so consequently does the electrical resistance of the electrode-slag-conducting metal-voltmeter circuit and thus the potential measured by the voltmeter changes too. This variation in potential the orders an increase in the rate of descent of the electrode until the original conditions are restored. However, as observed previously, the difference in immersion of the electrodes to be sensed does not exceed a few millimeters, at most; so the measurable potential variations are only of the order of a few dozen millivolts. Thus it is necessary to have instruments in the steel mill capable of measuring variations of the order of 0.1% on an accurate, reproducible basis, which is, of course, a very difficult and costly proposition, to say the least.

Another self-regulating system is the one disclosed in British Pat. No. 1,168,900, published on Oct. 29, 1969. According to this patent the electrodes are each connected to a terminal on the transformer secondary, while the central point of that secondary or of a reactance in parallel with the secondary is electrically connected to the bottom of the mold. With such an electrical connection, if differential electrode consumption occurs there will be a thinner layer of slag between the tip of the slower-melting electrode and the molten metal than in the case of the other. As this thinner layer of slag offers less resistance, more current can flow, thus increasing the power dissipated and hence the melting rate. The advantage of this system is that it is simple and, within certain limits, self-regulating; however, there are some drawbacks, as follows:

It works only with alternating-current plants.

It requires an additional electric circuit which can carry strong currents.

It eliminates the great advantage of the two-wire system, which is that of avoiding the passage of current through the molten metal and hence the strong convection currents induced in the liquid metal by the electromagnetic fields which occur; these convection currents drag particles of slag downward at the solidification front where some are captured and form inclusions, which are absolutely anathema in a costly process such as the ESR used to make high-quality products.

The present invention is designed to avoid these difficulties by providing a system which is:

capable of operating both with AC and with DC, capable of being easily connected to any two-wire ESR plant, simple and very cheap, reliable and capable of measuring differences of about one millimeter in electrode immersion.

The system for the control and regulation of electrode position in an ESR process as per the present invention is suitable for the case in which two electrodes are connected in series to a power source and each of the electrodes has an independent feed mechanism. The system is characterized by the fact that as regards the power source the two electrodes are connected in parallel to a group of three resistances in series, the center one being variable. Each electrode also has a resistance in series, formed in a known manner by the slag bath beneath each electrode, these additional resistances being electrically connected not only via the remaining slag bath but also and especially by the liquid and solid remelted metal. The system is further characterized by the fact that the potential of the slider of the variable resistance in the center of the group of three resistances in parallel with the electrodes, is compared with that of the metal bath during the whole remelting process, and the difference between the two potentials is used to ensure that the two electrodes can descend at a different rate.

The present invention will now be described in greater detail in relation to the accompanying drawing, which shows schematically a system according to one embodiment of the invention, and is given purely as an example and must in no way be construed as limiting the scope of the invention.

Reference to the schematic diagram indicates just how simple and economical the system of this invention is; and it will be readily understood that it is also very sensitive and reliable.

In any two-wire ESR plant with a stationary or movable mold 1, a plate 2 which closes the bottom of the mold 1, a power source 3 and a pair of consumable electrodes 4 and 5, dipping some distance into slag bath 6, connections 7 and 8 are provided on the power supply line, as well as conductors 9 and 10 which link these connections to a group of three resistances 11, 12 and 13 interconnected in series, the center resistance 12 being variable. An electrode height control unit 19, including a millivoltmeter, is connected electrically to slider 14 of resistance 12 and the conducting bottom 2 of mold 1, and thence through the solid and liquid remelted metal 15 also to the slag bath 6 and the two theoretical resistances 16 and 17 constituted by the layer of slag existing between the electrodes and the metal bath.

When the ESR unit is powered by direct current, all that needs to be done is to mechanically align the two electrodes at the start of the remelting operation and to move the slider 14 on resistance 12 until the millivoltmeter indicates a potential difference of zero between slider 14 and the metal 15. At this point, if one of the two electrodes starts to be used up more rapidly than the other, the thickness of the slag existing between its submerged end and the metal already melted will increase, as will the resistance of the layer of slag. The circuit will thus be altered and the millivoltmeter of unit 19 will indicate a potential difference (PD) between slider 14 and metal 15 other than zero. The sign of this PD will indicate which electrode is being consumed quickest, and an order will be given by unit 19 to increase the rate of descent of the relevant electrode, to the associated electrode feeder 20 or 21 of conventional construction and which is accordingly shown only diagrammatically in the drawing. This order will be given either through a Yes-No type of system (in which a maximum tolerable difference in immersion of the electrodes is fixed, then once this is exceeded a signal is issued ordering a variation in the rate of descent of the electrode) or through a continuous system of the "proportional plus integral plus derivative" (PID) type (where the variation order is given continuously). This latter kind of device is very well known in control engineering: its function is to give an output signal containing three components. The first component is proportional to the input signal, the second is proportional to the integral of the input signal, and the third is proportional to the derivative of the input signal. See "Instrumentation in Industry" by H. E. Soisson, John Wiley and Sons, 1975, pages 307–316, the disclosure of which is incorporated herein by reference.

With ESR plants running on alternating current, after having mechanically aligned the electrodes at the start of the remelting, it is necessary to set the slider 14 in such a way as to have a discrete value of say several dozen millivolts on meter 19, instead of a zero PD. In this way, if electrode consumption is uneven, the PD measured by instrument 19 will increase or decrease depending on which electrode is comsumed most rapidly. Of course, here too, the order to vary the rate of descent of the electrodes can be given either with a Yes-No or with a PID system.

Measurements made during trials with a system having a pair of concentric electrodes, the solid inner one being 80 mm in diameter, while the outer one was 160 mm in diameter and had 10 mm thick walls, indicated a sensitivity of about 30 millivolt per mm of difference of depth of immersion of the two electrodes.

As is apparent, the sensitivity is very good indeed, and moreover the currents flowing in the metal are extremely small owing to the high impedance of the millivoltmeter and electric height control unit 19.

It will also be apparent that the system is adapted for automatic control, by the circuitry shown, or for manual control. In that latter case, the millivoltmeter will be visually monitored and the feeding of electrode 4 or 5 will be selectively individually adjusted by conventional manually controlled means (not shown) to cause the millivoltmeter to return to its predetermined reading.

The quality of the steel obtained during the remelting trials was excellent and the ingots obtained were absolutely inclusion-free.

What is claimed is:

1. A method for controlling the position of the two electrodes in electro-slag remelting processes in which each of the electrodes has an independent descent control mechanism, comprising connecting the two electrodes in series with a relatively high electric potential sufficient to conduct electro-slag remelting and in parallel with a relatively low electric potential and with a group of three resistances that are in series with each other, the central resistance being variable according to the position of a slider on the central resistance, establishing an electrical potential of the slider which is characteristic of equal distance of the lower ends of the two electrodes from the metal undergoing electro-slag remelting, and selectively individually altering the descent of one of the electrodes in the course of electro-slag remelting, to maintain said predetermined potential substantially constant.

2. Apparatus for controlling the position of the two electrodes in electro-slag remelting processes, comprising an independent descent control mechanism for each of the electrodes, means connecting the two electrodes in series with a relatively high electric potential sufficient to conduct electro-slag remelting and in parallel with a relatively low electric potential and with a group of three resistances that are in series with each other, a slider on the central resistance by which the central resistance is variable according to the position of said slider thereon, means for establishing a potential of the slider characteristic of equal distance of the lower ends of the two electrodes from the metal undergoing electro-slag remelting, and means for selectively individually altering the descent of one of the electrodes in the course of electro-slag remelting, to maintain said predetermined potential substantially constant.

* * * * *